US012304025B2

(12) United States Patent
Matsuzawa

(10) Patent No.: US 12,304,025 B2
(45) Date of Patent: May 20, 2025

(54) JIG FOR MOUNTING AND DISMOUNTING PROCESSING TOOL

(71) Applicant: DISCO CORPORATION, Tokyo (JP)

(72) Inventor: Minoru Matsuzawa, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 386 days.

(21) Appl. No.: 18/062,186

(22) Filed: Dec. 6, 2022

(65) Prior Publication Data

US 2023/0201996 A1 Jun. 29, 2023

(30) Foreign Application Priority Data

Dec. 24, 2021 (JP) ..... 2021-210151

(51) Int. Cl.

| | |
|---|---|
| ***B24B 41/047*** | (2006.01) |
| ***B24B 41/06*** | (2012.01) |
| ***B24B 45/00*** | (2006.01) |
| ***B24B 49/08*** | (2006.01) |

(52) U.S. Cl.

CPC ..... *B24B 41/047* (2013.01); *B24B 41/061* (2013.01); *B24B 45/003* (2013.01); *B24B 49/08* (2013.01)

(58) Field of Classification Search

CPC ... B24B 7/228; B24B 27/0069; B24B 37/345; B24B 47/20; B24B 49/08; B24B 49/16; B24B 41/06; B24B 41/068; B24B 41/061; B24B 41/005; B24B 41/02; B24B 41/04; B24B 41/066; B24B 45/00–006; H01L 21/67092; H01L 21/304; H01L 21/68764; H01L 21/68785

See application file for complete search history.

(56) References Cited

U.S. PATENT DOCUMENTS

2019/0009379 A1* 1/2019 Kiuchi ..... H01L 21/67092

FOREIGN PATENT DOCUMENTS

| | | | |
|---|---|---|---|
| JP | 2002283211 A | | 10/2002 |
| JP | 2005138235 A | * | 6/2005 |
| JP | 2012152832 A | * | 8/2012 |

OTHER PUBLICATIONS

Machine translation of JP-2005138235-A (Year: 2005).*
Machine translation of JP-2012152832-A (Year: 2012).*

* cited by examiner

*Primary Examiner* — Robert F Neibaur
(74) *Attorney, Agent, or Firm* — GREER BURNS & CRAIN, LTD.

(57) ABSTRACT

A processing apparatus includes a chuck table having a holding surface for holding a workpiece thereon, a spindle having a distal end portion to which a mount for supporting the processing tool mounted thereon is fixed, and a seat structure disposed around the chuck table. A jig that is used when the processing tool is to be mounted on the mount includes a first support for supporting the processing tool thereon, a second support positioned below the first support and supported on the seat structure, and a main body disposed between the first support and the second support. The main body includes a balloon that is expandable when gas is introduced thereinto and that is collapsible when the gas is discharged therefrom. The balloon with the processing tool supported on the first support is able to be expanded to move the processing tool toward the mount.

6 Claims, 15 Drawing Sheets

JIG FOR MOUNTING AND DISMOUNTING PROCESSING TOOL

BACKGROUND OF THE INVENTION

Field of the Invention

The present invention relates to a jig that can be used to mount a processing tool on a mount of a processing apparatus, a method of mounting a processing tool on a mount by using a jig, and a method of dismounting a processing tool from a mount by using a jig.

Description of the Related Art

Workpieces such as semiconductor wafers are thinned down to a predetermined thickness by using a grinding apparatus, for example (see, for example, JP 2002-283211A). The grinding apparatus may be an in-feed grinding apparatus for grinding a workpiece in an in-feed grinding mode. The in-feed grinding apparatus includes a chuck table shaped as a circular plate that is rotatable about its central axis while holding a workpiece under suction thereon. The in-feed grinding apparatus also includes a grinding unit disposed above the chuck table. The grinding unit includes a cylindrical spindle extending substantially vertically, i.e., parallel to vertical directions, and having a lower end to which a mount shaped as a circular plate is fixed. The grinding unit also includes a grinding wheel fixed to a lower surface of the mount. The grinding wheel has an annular base and a plurality of grindstones disposed on a surface of the base and arrayed circumferentially along an outer edge of the base.

For mounting the grinding wheel on the mount, the operator normally supports the grinding wheel manually and then aligns a plurality of screw holes defined in the base and a plurality of through holes defined in the mount with each other. Then, the operator threads bolts into the respective screw holes in the base and tightens the bolts, fixing the grinding wheel to the mount. When the grinding wheel is used to grind workpieces, the grindstones are gradually worn by the grinding step. Therefore, the grinding wheel needs to be periodically replaced with a fresh one. However, it is a laborious task to replace grinding wheels that are relatively heavy. For this reason, there has been proposed a jig for supporting a grinding wheel when it is to be replaced (see, for example, JP 2012-152832A).

The proposed jig has a vertically movable table that can be lifted while rotating about its central axis with a grinding wheel supported thereon. The vertically movable table is shaped as a hollow cylinder having a circular upper end surface and has an internally threaded inner circumferential side surface. The jig also has a support base shaped as a hollow cylinder that is housed in a lower portion of the vertically movable table. The support base has an externally threaded outer circumferential side surface rotatably held in threaded engagement with the internally threaded inner circumferential side surface of the vertically movable table, so that the vertically movable table is rotatably supported on the support base. The vertically movable table that is rotatably supported on the support base is normally biased to move upwardly under predetermined forces by a biasing member disposed in the support base.

To lift a processing tool such as a grinding wheel toward the mount by using the jig, the processing tool is placed on the upper end surface of the vertically movable table, and the vertically movable table is lifted while rotating about its central axis. However, as the vertically movable table ascends until the upper surface of the base of the grinding wheel impinges upon the lower surface of the mount, the mount tends to be damaged on impact.

SUMMARY OF THE INVENTION

The present invention has been made in view of the above problem. It is an object of the present invention to provide a jig that will reduce the impact on a mount in mounting a processing tool on the mount by using the jig.

In accordance with an aspect of the present invention, there is provided a jig for mounting a processing tool on a mount of a processing apparatus. The processing apparatus includes a chuck table having a holding surface for holding a workpiece thereon, a spindle being disposed above the holding surface of the chuck table and having a distal end portion to which the mount for supporting the processing tool mounted thereon is fixed, and a seat structure disposed around the chuck table. The jig includes a first support for supporting the processing tool thereon, a second support positioned below the first support and supported on the seat structure, and a main body disposed between the first support and the second support. The main body includes a balloon that is expandable when gas is introduced thereinto and that is collapsible when the gas is discharged therefrom, an inlet port for introducing the gas therethrough into the balloon, and an outlet port for discharging the gas therethrough from the balloon. The balloon with the processing tool supported on the first support can be expanded to move the processing tool toward the mount.

Preferably, the balloon has a plurality of balloons joined together in a direction from the second support toward the first support.

Preferably, the processing tool includes a base and a grindstone assembly or a pad fixed to the base, and the first support has a base contact portion capable of contacting the base without contacting the grindstone assembly or the pad.

Preferably, further, the second support includes a leg adapted to be supported on the seat structure and a support table fixed to an upper end of the leg and adapted to be positioned above the chuck table, and the balloon has a lower surface held against an upper surface of the support table.

In accordance with another aspect of the present invention, there is provided a method of mounting a processing tool, by using a jig, on a mount of a processing apparatus. The processing apparatus includes a chuck table having a holding surface for holding a workpiece thereon, a spindle being disposed above the holding surface of the chuck table and having a distal end portion to which the mount for supporting the processing tool mounted thereon is fixed, and a seat structure disposed around the chuck table. The jig includes a first support for supporting the processing tool thereon, a second support positioned below the first support and supported on the seat structure, and a main body disposed between the first support and the second support. The main body includes a balloon that is expandable when gas is introduced thereinto and that is collapsible when the gas is discharged therefrom, an inlet port for introducing the gas therethrough into the balloon, and an outlet port for discharging the gas therethrough from the balloon. The method includes a placing step of placing the processing tool on the first support, a lifting step of, after the placing step, lifting the processing tool toward the mount by introducing the gas into the balloon to expand the balloon, and a fastening step of, after the lifting step, fastening the mount and a base of the processing tool to each other while the base of the processing tool is held in contact with the mount.

In accordance with a further aspect of the present invention, there is provided a method of dismounting a processing tool, by using a jig, from a mount of a processing apparatus. The processing apparatus includes a chuck table having a holding surface for holding a workpiece thereon, a spindle being disposed above the holding surface of the chuck table and having a distal end portion to which the mount for supporting the processing tool mounted thereon is fixed, and a seat structure disposed around the chuck table. The jig includes a first support for supporting the processing tool thereon, a second support positioned below the first support and supported on the seat structure, and a main body disposed between the first support and the second support. The main body includes a balloon that is expandable when gas is introduced thereinto and that is collapsible when the gas is discharged therefrom, an inlet port for introducing the gas therethrough into the balloon, and an outlet port for discharging the gas therethrough from the balloon. The method includes a contacting step of bringing the first support into contact with the processing tool by introducing the gas into the balloon to expand the balloon, a releasing step of, after the contacting step, releasing the mount and a base of the processing tool from each other, and a lowering step of, after the releasing step, lowering the processing tool toward the second support by discharging the gas from the balloon to collapse the balloon.

The jig according to the aspect of the present invention is used as follows. The balloon with the processing tool supported on the first support is expanded to move the processing tool toward the mount. Since the balloon is expanded to move the processing tool toward the mount, even if the processing tool collides with the mount, the impact on the mount is reduced by the action of the balloon to absorb the impact. In addition, the jig can be used not only to mount the processing tool on the mount, but also to dismount the processing tool from the mount. Inasmuch as the jig that supports the processing tool allows the operator to mount the processing tool on the mount and to dismount the processing tool from the mount without supporting the processing tool by hand, the labor required of the operator to mount and dismount the processing tool can be reduced.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
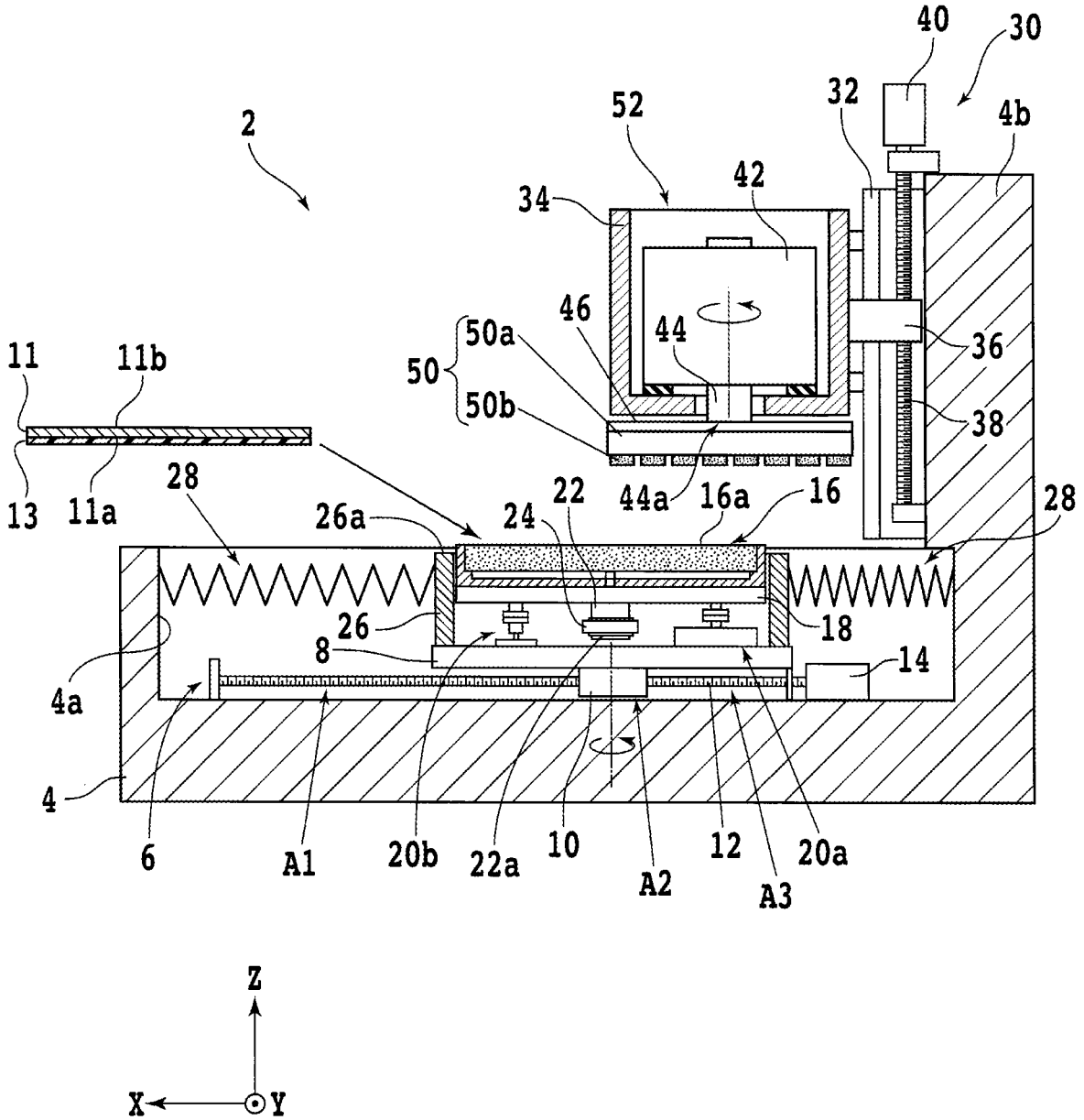
FIG. 1 is a side elevational view, partly in cross section, of a grinding apparatus.

Preferred embodiments of the present invention will be described below with reference to the accompanying drawings. First, a grinding apparatus, i.e., a processing apparatus, 2 (see FIG. 1) incorporating a jig 60 according to a first embodiment will be described below. FIG. 1 illustrates the grinding apparatus 2 in side elevation, partly in cross section. In FIG. 1, the grinding apparatus 2 is illustrated in reference to a three-dimensional coordinate system having X-, Y-, and Z-axes indicated respectively by the arrows X, Y, and Z. X-axis directions, i.e., forward and rearward directions, that extend horizontally parallel to the X-axis, and Y-axis directions, i.e., leftward and rightward directions, that extend horizontally parallel to the Y-axis are perpendicular to each other on a horizontal plane. Z-axis directions, i.e., upward and downward directions, that extend vertically parallel to the Z-axis are perpendicular to the X-axis directions and the Y-axis directions. The grinding apparatus 2 has a base 4 supporting thereon and housing therein various components of the grinding apparatus 2. The base 4 has an oblong cavity 4*a* defined in the shape of a rectangular parallelepiped and open upwardly through an upper surface of the base 4. The cavity 4*a* has a longitudinal axis extending along the X-axis.

A ball-screw-type X-axis moving mechanism 6 is disposed in the cavity 4*a*. The X-axis moving mechanism 6 has a pair of guide rails, not illustrated, extending substantially along the X-axis and spaced from each other and a movable plate 8 slidably supported on the guide rails. A nut 10 is attached to a lower surface of the movable plate 8 and is operatively threaded over a screw shaft 12 extending along the X-axis. The screw shaft 12 is rotatably disposed between the guide rails for rotation about its central axis. The screw shaft 12 has an end coupled to a rotary actuator 14 such as an electric motor. When the rotary actuator 14 is energized, it rotates the screw shaft 12 about its central axis, causing the nut 10 to move the movable plate 8 along the X-axis.

A chuck table 16 shaped as a circular plate is disposed above the movable plate 8. The chuck table 16 has a diameter of 370 mm, for example. The chuck table 16 has a frame shaped as a circular plate made of non-porous ceramic. The frame has a circular recess defined therein and open upwardly. The recess houses a porous plate shaped as a circular plate made of porous ceramic and fixed in the recess. The porous plate has a diameter of 300 mm, for example.

The frame has a fluid channel, not illustrated, defined therein. The fluid channel fluidly connects the porous plate to a suction source, not illustrated, such as an ejector. When the suction source is actuated, it generates a negative pressure that is transmitted through the fluid channel and the porous plate to an upper surface thereof. The upper surface of the porous plate and an upper surface of the frame lie substantially flatwise as a holding surface 16*a* of the chuck table 16. Though the holding surface 16*a* is illustrated as a flat surface in FIG. 1, the holding surface 16*a* is actually shaped as a conical surface whose center protrudes upwardly beyond an outer circumferential portion thereof by a small distance of 20 μm, for example. When the negative pressure from the suction source is applied to the holding surface 16*a* of the chuck table 16 with a workpiece 11 placed on the holding surface 16*a*, the workpiece 11 is held under suction on the holding surface 16*a* while being deformed complementarily in shape to the conical holding surface 16*a*.

The chuck table 16 is rotatably supported on an annular table base 18 by a bearing, not illustrated. The table base 18 is supported on the movable plate 8 by a tilt adjusting mechanism including a stationary support leg 20*a* and two movable support legs 20*b*. The stationary support leg 20*a* has an upper end whose vertical position remains unchanged, whereas the movable support legs 20*b* have upper ends movable along the Z-axis. In FIG. 1, one of the movable support legs 20*b* is illustrated, and the other movable support leg 20*b* is omitted from illustration. The stationary support leg 20*a* and the movable support legs 20*b* are mounted on the movable plate 8. The vertical positions of the upper ends of the movable support legs 20*b* are adjusted to adjust the tilt of the table base 18 in order to make part of the conical holding surface 16*a* substantially parallel to a grinding surface to be described later.

A rotary actuator, not illustrated, such as an electric motor is mounted on the movable plate 8 and has an output shaft with a pulley, not illustrated, attached thereto. The rotary actuator transmits its rotative power to a rotational shaft 22 connected to a lower portion of the chuck table 16. The rotational shaft 22 extends through a through hole, not illustrated, defined diametrically centrally in the table base 18 and protrudes downwardly from the table base 18. The rotational shaft 22 has a lower end portion with a pulley 22*a* attached thereto. An endless belt 24 is trained around the pulley 22*a* on the rotational shaft 22 and the pulley on the output shaft of the rotary actuator. When the rotary actuator is energized, the rotation of the output shaft of the rotary actuator is transmitted through the endless belt 24 to the rotational shaft 22.

A hollow seat structure 26 having a contour shaped like a rectangular parallelepiped is disposed on an upper surface of the movable plate 8 in surrounding relation to the chuck table 16. The seat structure 26 has an upper surface 26*a* with a circular opening 26*b* (see FIG. 2) defined therein. Through the circular opening 26*b*, the chuck table 16 is exposed. The holding surface 16*a* of the chuck table 16 is positioned in its entirety upwardly of the upper surface 26*a* of the seat structure 26. A bellows-like cover 28 that is extendible and contractible along the X-axis is disposed on both sides of the seat structure 26 along the X-axis. The cover 28 lies above the X-axis moving mechanism 6 to prevent the X-axis moving mechanism 6 from being contaminated by swarf, grinding water, etc., produced when the workpiece 11 is ground on the grinding apparatus 2.

The grinding apparatus 2 includes a support structure 4*b* shaped as a rectangular parallelepiped. The support structure 4*b* is disposed behind the X-axis moving mechanism 6 in one of the X-axis directions and protrudes upwardly from the base 4. The support structure 4*b* is integral with the base 4. A ball-screw-type grinding feed unit 30 is mounted on a front side surface of the support structure 4*b* that faces in the other of the X-axis directions. The grinding feed unit 30 includes a pair of guide rails 32 being fixedly mounted on the front side surface of the support structure 4*b* and extending along the Z-axis. A hollow cylindrical holder 34 having a circular lower end wall is slidably mounted on the guide rails 32 for sliding movement along the Z-axis.

A nut 36 is mounted on a rear surface of the holder 34 integrally therewith. The nut 36 is operatively threaded over a screw shaft 38 that is rotatable about its central axis with respect to the nut 36. The screw shaft 38 extends vertically along the Z-axis and is disposed between the guide rails 32. The screw shaft 38 has an upper end coupled to a rotary actuator 40 such as an electric motor for rotating the screw shaft 38. When the rotary actuator 40 is energized, it rotates the screw shaft 38 about its central axis, causing the nut 36 to move the holder 34 vertically along the Z-axis.

The holder 34 houses therein a spindle housing 42 shaped as a hollow cylinder. A cylindrical spindle 44 having its longitudinal axis extending along the Z-axis includes a portion, i.e., an upper end portion, rotatably housed in the spindle housing 42. The spindle 44 has an upper end. A rotary actuator, not illustrated, such as an electric motor for rotating the spindle 44 about its central axis is provided near the upper end of the spindle 44. The spindle 44 also has a lower end portion, i.e., a distal end portion, 44*a* protruding downwardly from the holder 34 through a through opening defined in the lower end wall of the holder 34. The lower end portion 44*a* is disposed above the holding surface 16*a* of the chuck table 16.

A mount 46 shaped as a circular plate is fixed to the lower end portion 44*a* of the spindle 44. An annular grinding wheel, i.e., a processing tool, 50 is mounted on a lower surface of the mount 46 by a plurality of bolts 48 (see FIG. 2). The spindle 44, the mount 46, the grinding wheel 50, and the spindle housing 42 jointly make up a grinding unit 52 for grinding the workpiece 11.

Figure 2:
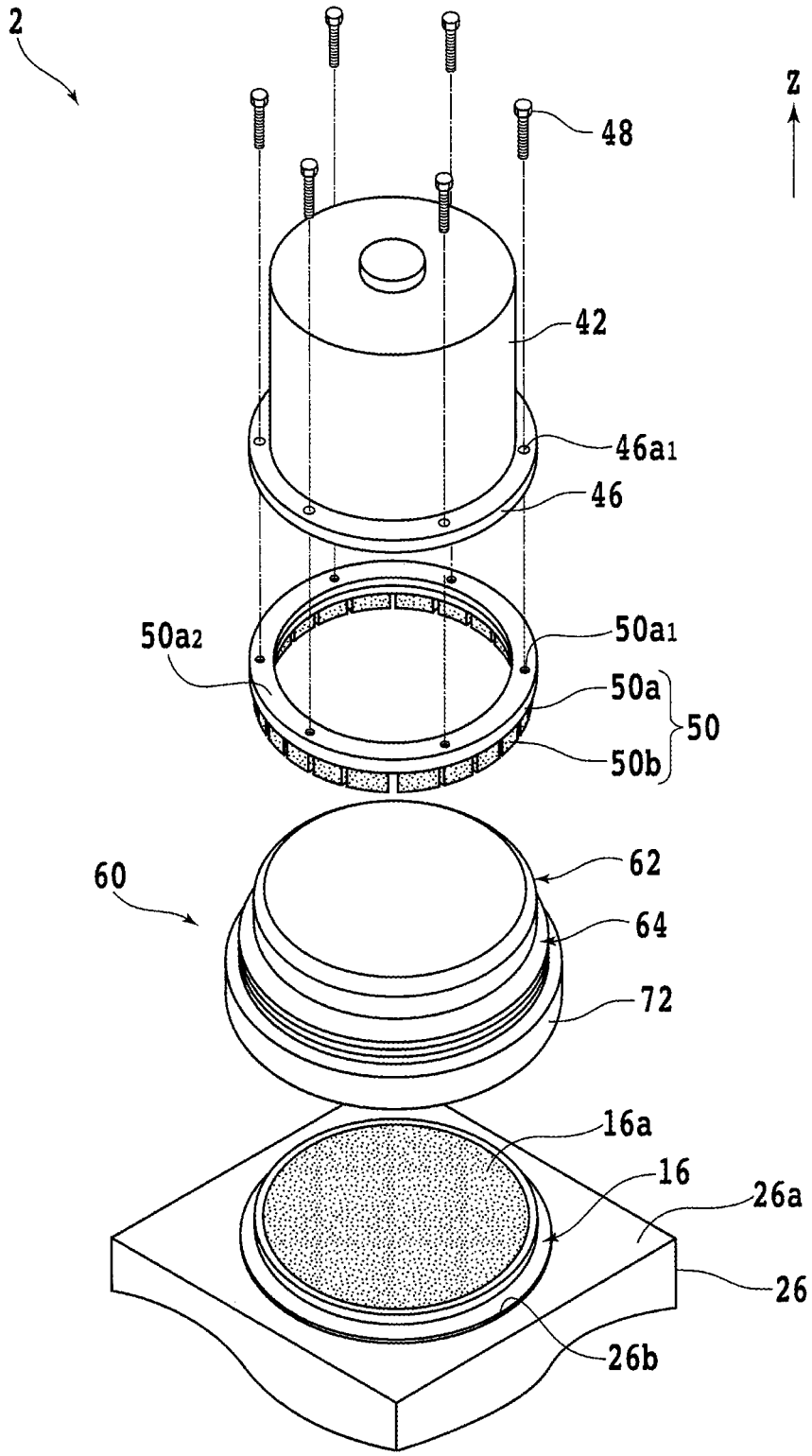
FIG. 2 is an exploded perspective view of a grinding wheel, a jig, and other members according to a first embodiment of the present invention.

As illustrated in FIG. 2, the mount 46 includes an outer circumferential flange having a plurality of, e.g., six, through holes $\mathbf{46}a_1$ defined therein. The through holes $\mathbf{46}a_1$ are spaced at substantially equal intervals circumferentially around the mount 46. The grinding wheel 50 includes an annular base 50*a* having an outside diameter of 300 mm, for example, that is substantially the same as the diameter of the mount 46. The base 50*a* is made of a metal material such as aluminum alloy. The base 50*a* has a plurality of, e.g., six, screw holes $\mathbf{50}a_1$ defined therein. The screw holes $\mathbf{50}a_1$ are spaced at substantially equal intervals circumferentially around the base 50*a*. The screw holes $\mathbf{50}a_1$ are open upwardly at an upper surface $\mathbf{50}a_2$ of the base 50*a*.

Each of the screw holes $\mathbf{50}a_1$ is positioned in vertical alignment with corresponding one of the through holes $\mathbf{46}a_1$ along the Z-axis. The grinding wheel 50 is joined to the mount 46 as follows. The base 50*a* is held against the outer circumferential flange of the mount 46 with the through holes $\mathbf{46}a_1$ positionally aligned with the respective screw holes $\mathbf{50}a_1$. Then, the bolts 48 are threaded through the through holes $\mathbf{46}a_1$ into the screw holes $\mathbf{50}a_1$ and tightened to fasten the grinding wheel 50 to the spindle 44 with the mount 46 interposed therebetween. In FIG. 1, the bolts 48 are omitted from illustration for the sake of brevity.

A plurality of grindstones, e.g., a grindstone assembly, 50*b* are fixed to a lower surface of the base 50*a* of the grinding wheel 50 which is opposite to the upper surface $50a_2$. Each of the grindstones 50*b* is made up of abrasive grains of diamond or cubic boron nitride (cBN) and a binder, i.e., a bonding material, of resin, ceramic, metal, or the like that binds the abrasive grains. The grindstones 50*b*, each essentially shaped as a block, are arranged in an annular array and spaced at substantially equal intervals circumferentially around the base 50*a*. When the spindle 44 is rotated about its central axis, the grindstones 50*b* move along an annular track with their lower surfaces jointly providing an annular grinding surface.

As illustrated in FIG. 1, the workpiece 11 to be ground by the grinding apparatus 2 is, for example, a wafer of silicon shaped as a circular plate. The workpiece 11 has a plurality of devices such as integrated circuits (ICs) constructed on a face side 11*a* thereof. When the workpiece 11 is to be ground by the grinding apparatus 2, a protective tape 13 of resin is affixed to the face side 11*a* to protect the devices. The chuck table 16 is brought to a loading/unloading position A1 in a front area of the grinding apparatus 2, and then the workpiece 11 is placed on the holding surface 16*a* such that a reverse side 11*b* of the workpiece 11 which is opposite to the face side 11*a* is exposed upwardly.

Then, the face side 11*a* of the workpiece 11 is held under suction on the holding surface 16*a*, and the chuck table 16 is moved to a grinding position A2 behind the loading/unloading position A1. In the grinding position A2, the chuck table 16 is rotated about its central axis at a predetermined rotational speed of 300 rpm, for example, and the spindle 44 is also rotated about its central axis at a predetermined rotational speed of 3200 rpm, for example. Then, while grinding water such as pure water is supplied at a predetermined rate to the grindstones 50*b*, the grinding feed unit 30 lowers, i.e., grinding-feeds, the grinding unit 52 at a predetermined speed of 1.0 μm/s., for example. The grinding surface provided by the lower surfaces of the grindstones 50*b* is brought into abrasive contact with the reverse side 11*b* of the workpiece 11, thereby grinding the reverse side 11*b*.

When the grindstones 50*b* have ground the workpiece 11 to thin down the workpiece 11 to a predetermined thickness, the grinding unit 52 is lifted, and the chuck table 16 is brought back to the loading/unloading position A1. Then, the ground workpiece 11 is removed from the chuck table 16, and an unground workpiece 11 is placed on the chuck table 16. In this manner, a plurality of workpieces 11 are successively ground on the grinding apparatus 2. As the grindstones 50*b* successively grind those workpieces 11, the grindstones 50*b* are gradually worn to the extent that the grinding wheel 50 needs to be replaced with a fresh grinding wheel 50.

Figure 3:
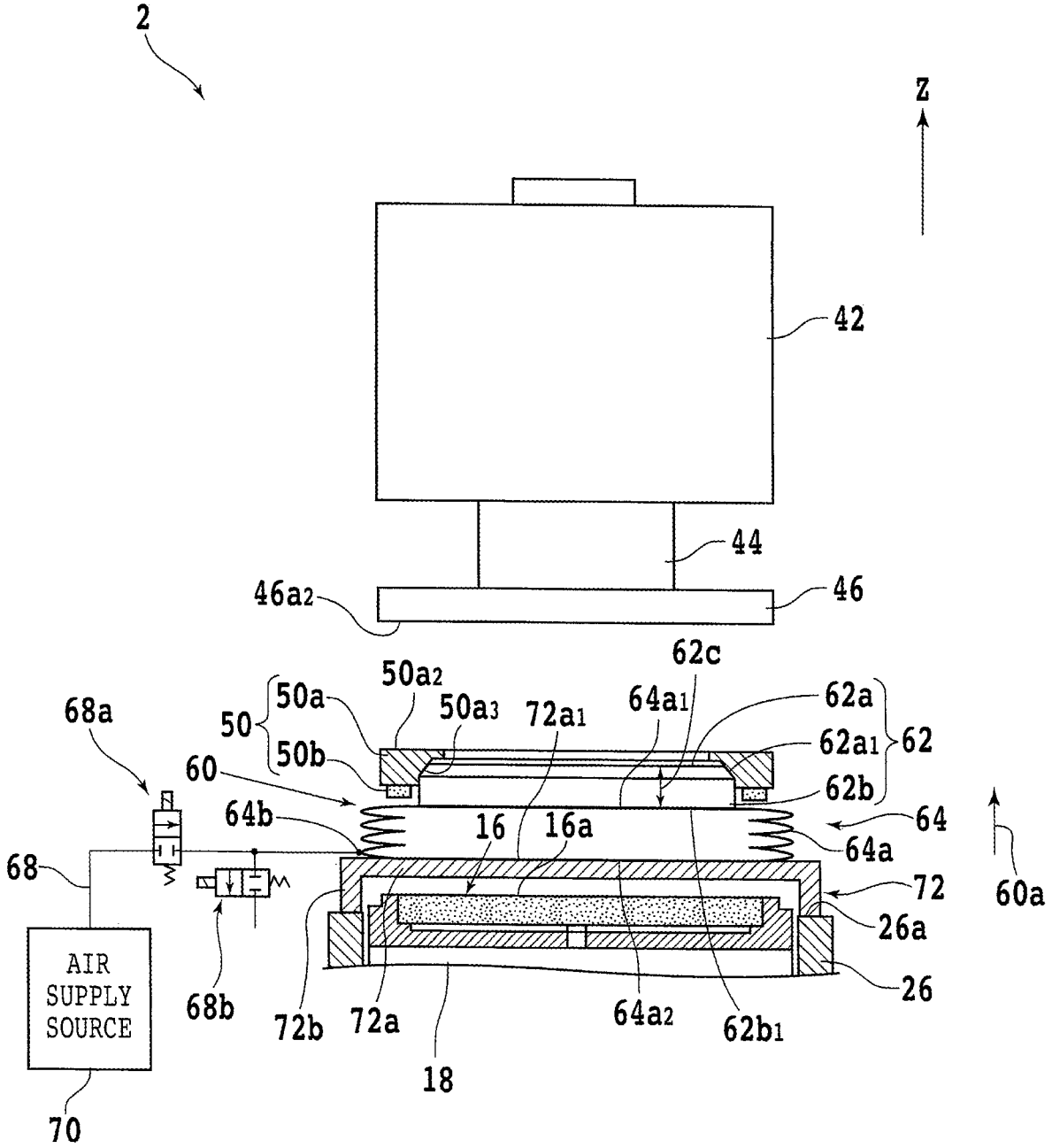
FIG. 3 is a side elevational view, partly in cross section, illustrating among others a balloon in a collapsed state.

The used grinding wheel 50 is replaced by using a jig 60 (see FIG. 2). FIG. 2 illustrates the grinding wheel 50, the jig 60, and other members in exploded perspective. The jig 60 has a first support 62 made of a metal material such as aluminum alloy. As illustrated in FIG. 3, the first support 62 includes a frustoconical base contact portion 62*a* and a base 62*b* shaped as a circular plate. The jig 60 also includes a main body 64 having an upper surface $64a_1$ on which the first support 62 is mounted.

The first support 62 supports the grinding wheel 50 thereon while keeping an outer circumferential side surface $62a_1$ thereof in contact with an inner circumferential side surface $50a_3$ of the base 50*a*. At this time, the grindstones 50*b* are spaced radially outwardly from the base 62*b*. Therefore, the first support 62 is held out of contact with the grindstones 50*b* when it supports the grinding wheel 50. The first support 62 has a height 62*c* that is large enough to keep the lower surfaces of the grindstones 50*b* of the grinding wheel 50 supported on the first support 62 out of contact with the upper surface $64a_1$ of the main body 64.

Consequently, when a fresh grinding wheel 50 is supported on the first support 62 in order to be mounted on the mount 46, the grindstones 50*b* of the fresh grinding wheel 50 do not contact the components of the jig 60. The grindstones 50*b* of the fresh grinding wheel 50 are thus prevented from being smeared by dust, dirt, etc., deposited on the jig 60. In addition, since the grindstones 50*b* do not contact the components of the jig 60 that is supporting the grinding wheel 50, when the grinding wheel 50 is lifted and the base 50*a* thereof contacts the mount 46, the grindstones 50*b* are not physically pressed along the Z-axis. Therefore, any damage that may be caused to the grindstones 50*b* when the grinding wheel 50 is mounted on the mount 46 can be minimized.

The main body 64 is of a hollow cylindrical shape having a bellows-like side wall. The upper surface $64a_1$ of the main body 64 is fixed by adhesive bonding or the like to a lower surface $62b_1$ of the first support 62. The main body 64 has an elastic expandable and shrinkable balloon 64*a* including the bellows-like side wall. FIG. 3 illustrates the balloon 64*a* in a collapsed state. The balloon 64*a* is made of woven fabric of resin fibers or a membrane of resin, rubber, or the like, for example.

The bellows-like side wall of the balloon 64*a* has a plurality of alternate peaks and valleys in a heightwise direction 60*a* along the Z-axis, i.e., a direction from a second support 72 to be described later toward the first support 62. When the balloon 64*a* is expanded, the bellows-like side wall makes the balloon 64*a* to be expandable more easily along the heightwise direction 60*a* than the radial directions of the balloon 64*a*. When the balloon 64*a* is shrunk, the bellows-like side wall allows the balloon 64*a* to be collapsed into a compact form in a direction opposite to the heightwise direction 60*a*.

According to the present embodiment, the balloon 64*a* is expanded to move the grinding wheel 50 toward the mount 46. Therefore, even if the grinding wheel 50 collides with the mount 46, the impact on the mount 46 is reduced by the action of the balloon 64*a* to absorb the impact. In addition, the jig 60 according to the present embodiment does not have a biasing member for biasing a vertically movable table upwardly, unlike the jig disclosed in the aforementioned JP 2012-152832A. Because the jig 60 is free of such a biasing member, the jig 60 is structurally simpler and lighter in weight than the disclosed jig including the biasing member.

The balloon 64*a* has a single continuous space defined therein, and the space is fluidly connected to an inlet/outlet port 64*b* on the lower end of the side wall of the balloon 64*a*, for example. In FIG. 3, the inlet/outlet port 64*b* is indicated by a black dot. The inlet/outlet port 64*b* functions as an inlet port for introducing air, i.e., gas, 70*a* (see FIG. 4) into the balloon 64*a* and an outlet port for discharging the air 70*a* out of the balloon 64*a*.

The inlet/outlet port 64*b* is fluidly connected to an air supply source 70 through a pipe 68. The air supply source 70 is installed in a building such as a factory building and includes an air compressor, a filter, an air tank, etc. A first solenoid-operated valve 68*a* is connected to the pipe 68 somewhere between the air supply source 70 and the inlet/outlet port 64*b*, and delivers the air 70*a* through the pipe 68 into the balloon 64*a* when it is opened. A second solenoid-operated valve 68*b* is also connected to the pipe 68 between the first solenoid-operated valve 68*a* and the inlet/outlet port 64*b*, and discharges the air 70*a* from the balloon 64*a* when it is opened.

The first solenoid-operated valve 68*a* and the second solenoid-operated valve 68*b* according to the present embodiment are manually controlled by the operator such that they can be manually opened and closed by the operator. However, the first solenoid-operated valve 68*a* and the second solenoid-operated valve 68*b* may be computer-controlled to be opened and closed by control signals from a computer incorporated in the grinding apparatus 2. A proportional control valve, not illustrated, is connected to the pipe 68 somewhere between the air supply source 70 and the first solenoid-operated valve 68*a* to control the pressure, flow rate, etc., of the air 70*a* supplied from the air supply source 70 to the inlet/outlet port 64*b*.

The balloon 64*a* has a lower surface 64$a_2$ held against and secured to an upper surface 72$a_1$ of the second support 72 that is of a hollow cylindrical shape, by adhesive bonding or the like. Therefore, the balloon 64*a* is disposed between and joined to the first support 62 and the second support 72. The second support 72 that is positioned below the first support 62 has a support table 72*a* shaped as a circular plate. The support table 72*a* has an upper surface as the upper surface 72$a_1$ of the second support 72, and the upper surface 72$a_1$ is secured to the lower surface 64$a_2$ of the balloon 64*a* by adhesive bonding or the like, as described above.

The second support 72 also includes a hollow cylindrical leg 72*b* whose upper end is fixed to an outer circumferential portion of the lower surface of the support table 72*a*. The leg 72*b* is supported on the seat structure 26 with a lower end face of the leg 72*b* held in contact with the upper surface 26*a* of the seat structure 26. The leg 72*b* has a predetermined length in the heightwise direction 60*a* that is larger than the distance from the height or vertical position of the upper surface 26*a* of the seat structure 26 to the highest position of the holding surface 16*a*. Therefore, when the leg 72*b* of the second support 72 is supported on the seat structure 26, the support table 72*a* is positioned above the chuck table 16 without fail. As a result, when the jig 60 is supported on the seat structure 26, the second support 72 is kept out of contact with the holding surface 16*a*. The holding surface 16*a* is thus prevented from being smeared by dust, dirt, etc., deposited on the support table 72*a*.

Figure 4:
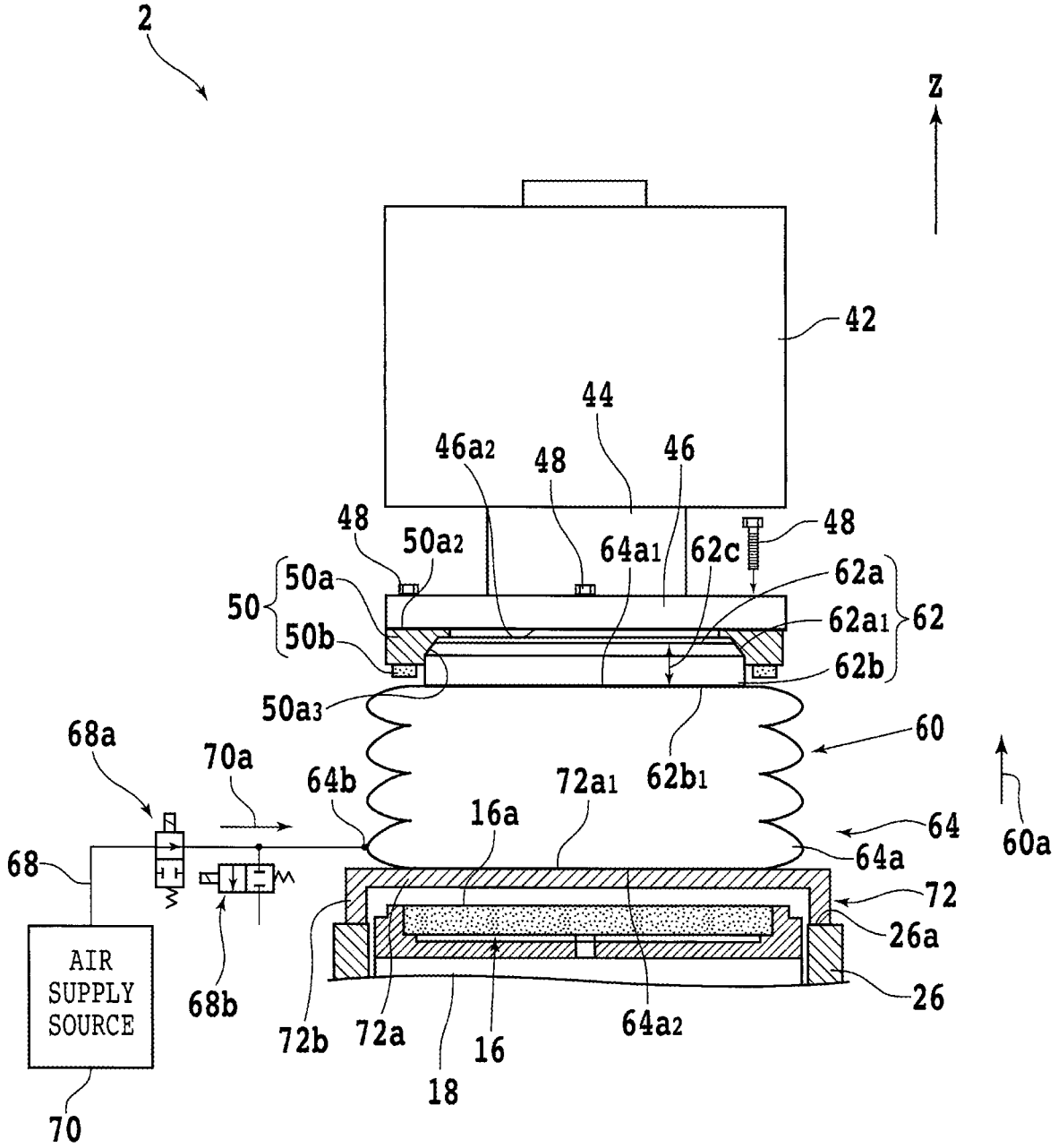
FIG. 4 is a side elevational view, partly in cross section, illustrating among others the balloon in an expanded state.

With the jig 60 supported on the seat structure 26, the first solenoid-operated valve 68*a* is opened, and the second solenoid-operated valve 68*b* is closed. Then, the air 70*a* from the air supply source 70 is introduced via the pipe 68 into the balloon 64*a*, expanding the balloon 64*a* along the heightwise direction 60*a*. FIG. 4 illustrates the balloon 64*a* in an expanded state in side elevation, partly in cross section.

When the balloon 64*a* is expanded, it moves the grinding wheel 50 upwardly toward the mount 46. Specifically, when the balloon 64*a* is expanded until the height of the balloon 64*a* as measured from the upper surface 64$a_1$ to the lower surface 64$a_2$ reaches a value in the range of 10 cm to 15 cm, for example, the upper surface 50$a_2$ of the base 50*a* contacts a lower surface 46$a_2$ of the mount 46. Then, the mount 46 and the grinding wheel 50 on the jig 60 are fastened to each other by the bolts 48, so that the grinding wheel 50 is mounted on the spindle 44 by the mount 46.

Figure 5:
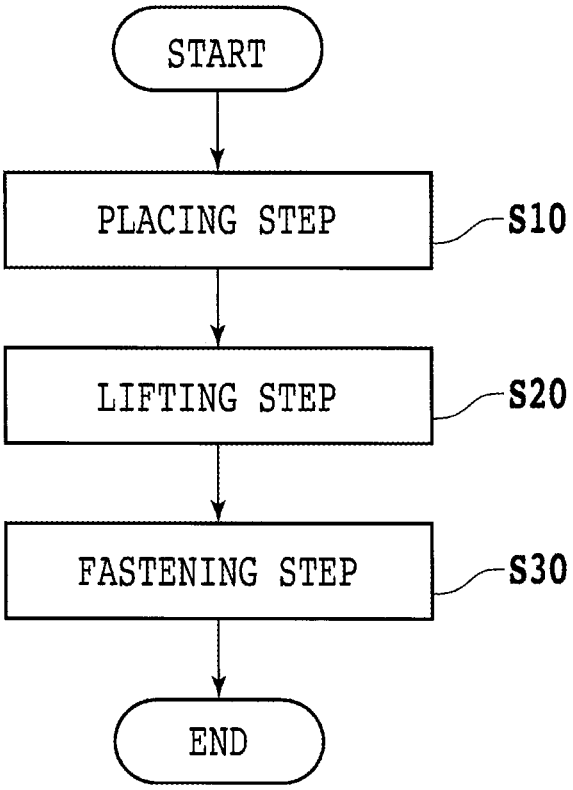
FIG. 5 is a flowchart of the sequence of a method of mounting a processing tool on a mount.

A method of mounting the grinding wheel 50 on the mount 46 by using the jig 60 will be described below with reference to FIGS. 5 through 8. FIG. 5 illustrates the sequence of the mounting method. As illustrated in FIG. 5, the mounting method includes placing step S10, lifting step S20, and fastening step S30. In placing step S10 and lifting step S20 of the method, the grinding wheel 50 is not fastened to the mount 46. The grinding wheel 50 is fastened to the mount 46 in fastening step S30.

Figure 6:
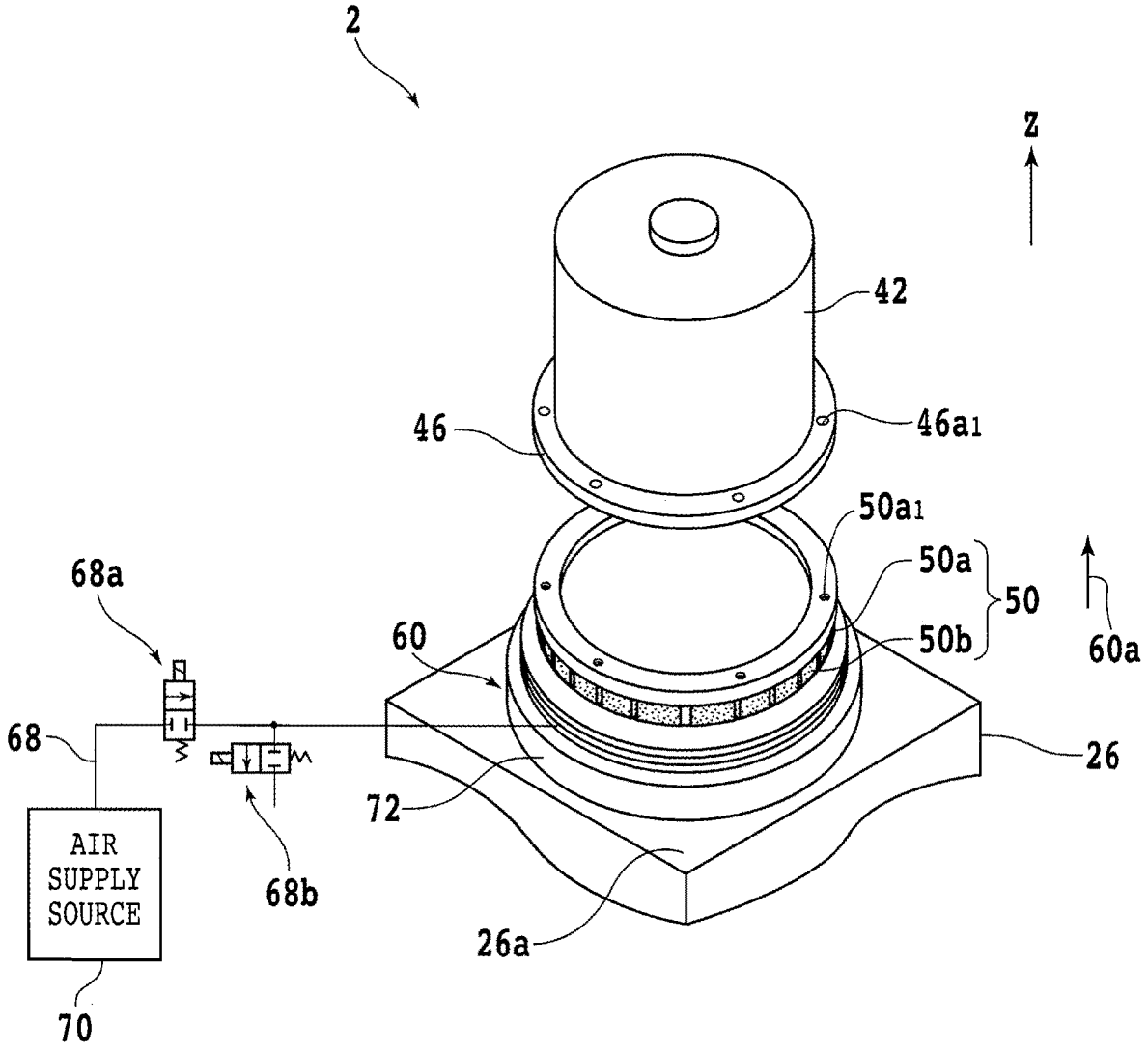
FIG. 6 is a perspective view illustrating a placing step.

After the chuck table 16 has been moved to the loading/unloading position A1, the jig 60 is placed on the seat structure 26 such that the jig 60 covers the holding surface 16*a*, and the grinding wheel 50 is placed on the first support 62 (placing step S10). FIG. 6 illustrates placing step S10 in perspective. In placing step S10, as described above, the grinding wheel 50 is placed on the first support 62 such that the base contact portion 62*a* of the first support 62 is held in contact with the inner circumferential side surface 50$a_3$ of the base 50*a* but not with the grindstones 50*b*.

After placing step S10, the X-axis moving mechanism 6 moves the chuck table 16 to a replacing position A3 (see FIG. 1) directly below the spindle 44. With the grinding wheel 50 supported on the first support 62, the second solenoid-operated valve 68*b* remains closed, and the first solenoid-operated valve 68*a* is opened. Accordingly, the air 70*a* is introduced from the air supply source 70 into the balloon 64*a*, expanding the balloon 64*a*.

Figure 7:
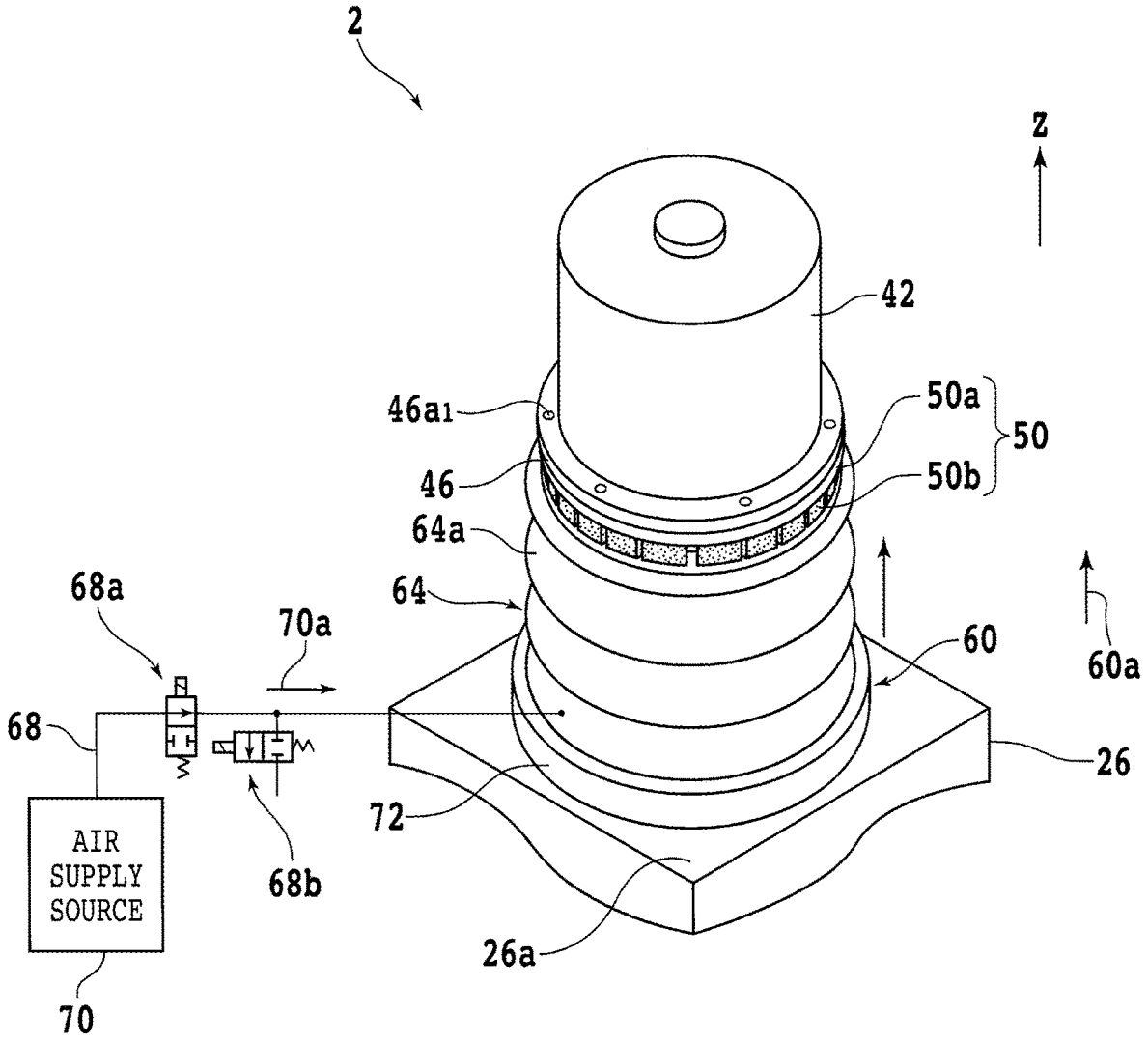
FIG. 7 is a perspective view illustrating a lifting step.

When the balloon 64*a* is expanded, it lifts the grinding wheel 50 along the heightwise direction 60*a* to bring the base 50*a* closer to the mount 46 (lifting step S20). FIG. 7 illustrates lifting step S20 in perspective. In lifting step S20, the grinding wheel 50 is lifted along the heightwise direction 60*a* until the upper surface 50$a_2$ of the base 50*a* contacts the lower surface 46$a_2$ of the mount 46. The speed at which the grinding wheel 50 is lifted is adjusted by controlling the rate at which the air 70*a* flows from the air supply source 70 into the balloon 64*a*. After the upper surface 50$a_2$ of the base 50*a* has contacted the lower surface 46$a_2$ of the mount 46, the first solenoid-operated valve 68*a* is closed.

Figure 8:
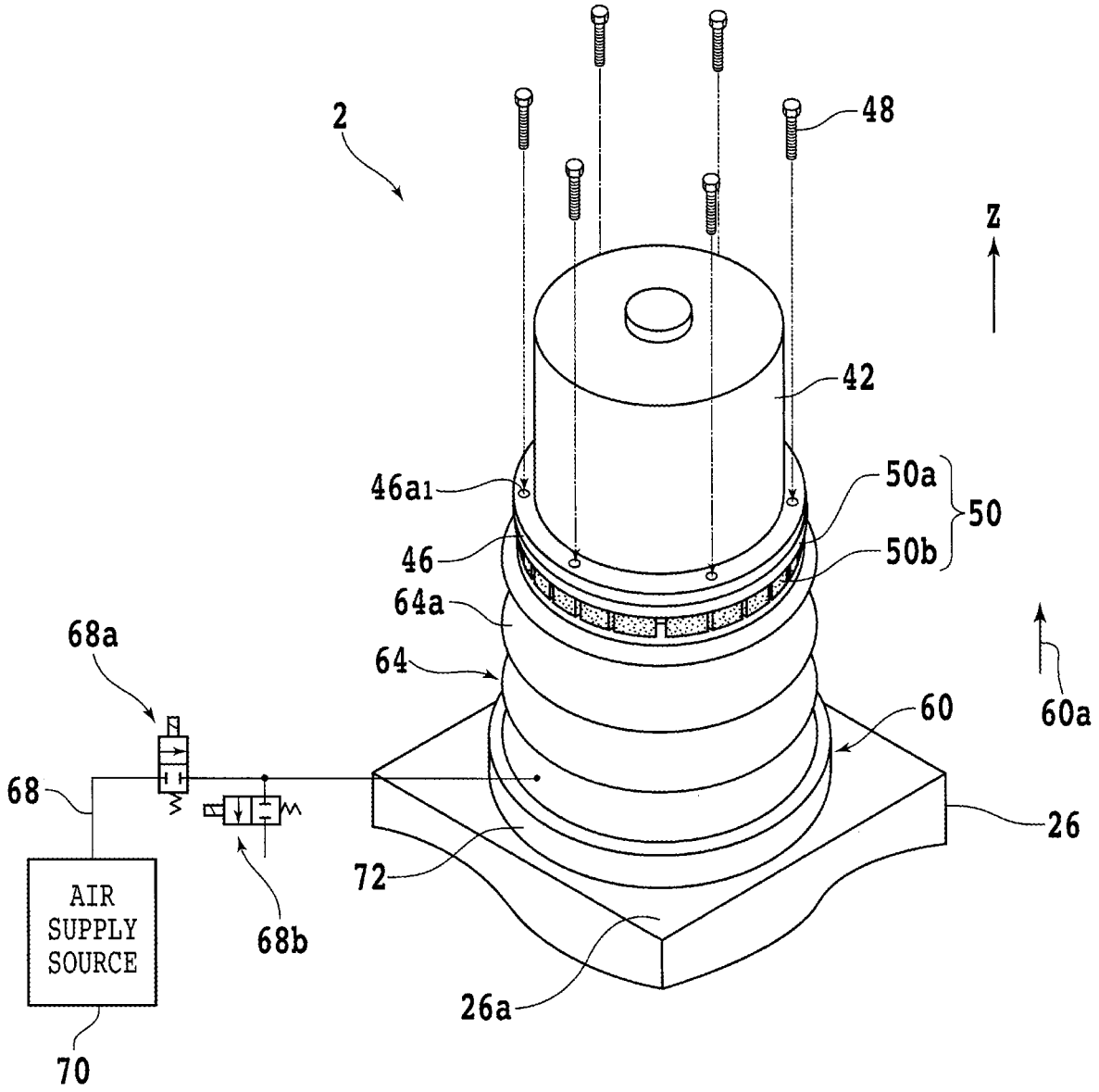
FIG. 8 is a perspective view illustrating a fixing step.

After lifting step S20, while the upper surface 50$a_2$ of the base 50*a* is kept in contact with the lower surface 46$a_2$ of the mount 46, the mount 46 and the base 50*a* are fastened together by the bolts 48 (fastening step S30). FIG. 8 illustrates fastening step S30 in perspective.

According to the present embodiment, using the jig 60 to move the grinding wheel 50 toward the mount 46 is advantageous in that, since the expansion of the balloon 64*a* moves the grinding wheel 50 toward the mount 46, even if the grinding wheel 50 collides with the mount 46 in lifting step S20, the impact on the mount 46 is reduced by the action of the balloon 64*a* to absorb the impact.

Figure 9:
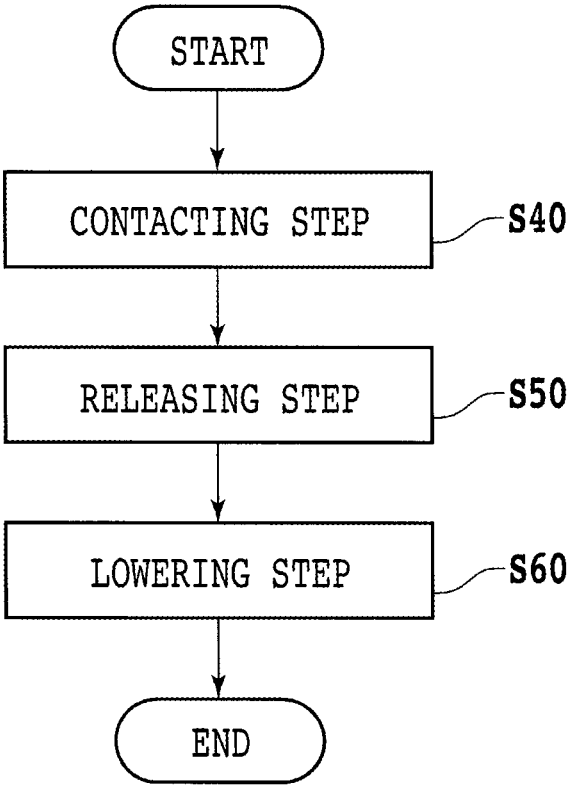
FIG. 9 is a flowchart of the sequence of a method of dismounting the processing tool from the mount.

A method of dismounting the grinding wheel 50 from the mount 46 by using the jig 60 will be described below with reference to FIGS. 9 through 12. FIG. 9 illustrates the sequence of the dismounting method. As illustrated in FIG. 9, the dismounting method includes contacting step S40, releasing step S50, and lowering step S60. For dismounting the grinding wheel 50 from the mount 46, the chuck table 16 is moved to the loading/unloading position A1, and the jig 60 is placed on the seat structure 26. Then, the chuck table 16 is moved to the replacing position A3.

Figure 10:
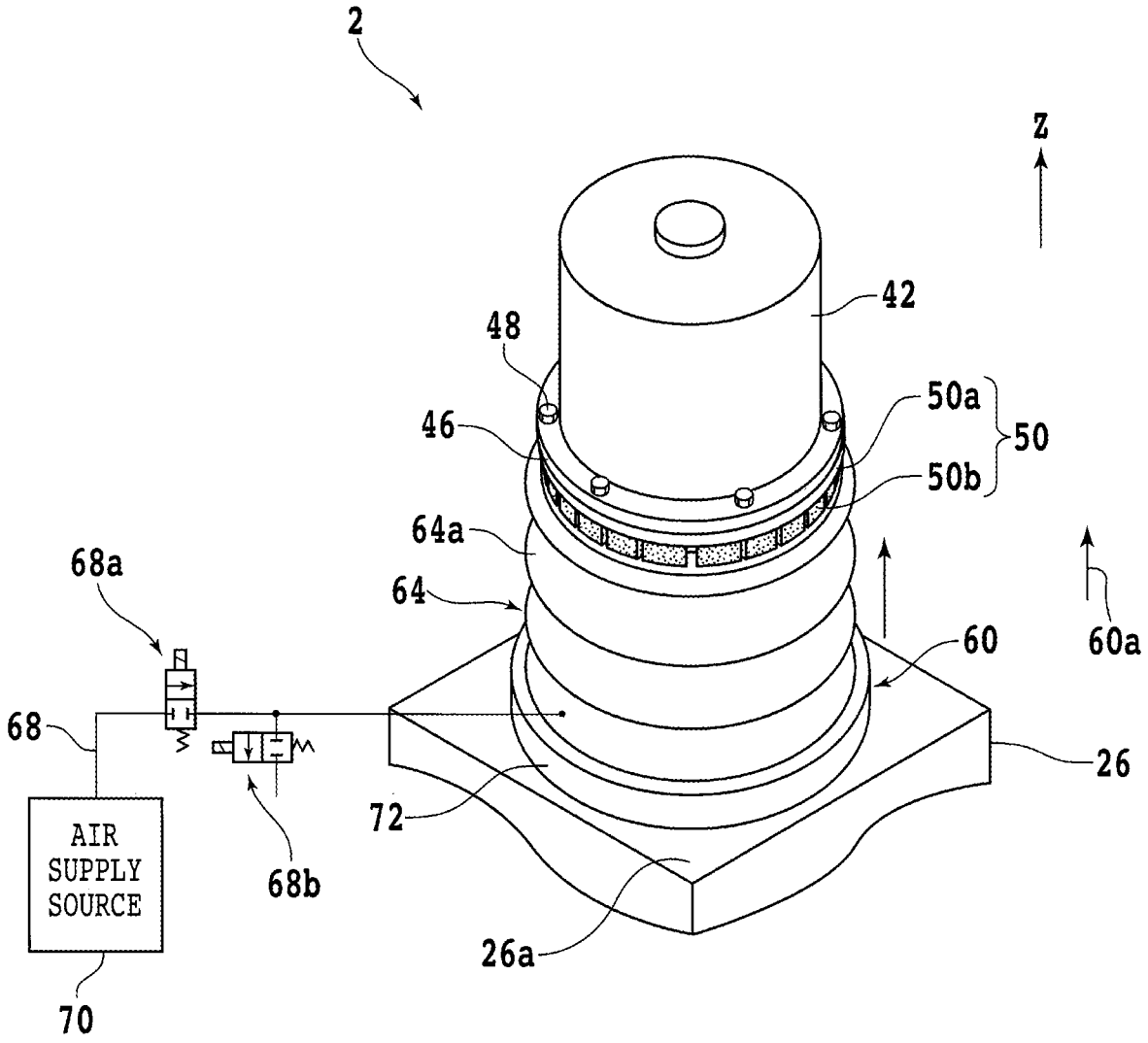
FIG. 10 is a perspective view illustrating the jig and other members that have undergone a contacting step.

Then, the second solenoid-operated valve 68*b* remains closed, and the first solenoid-operated valve 68*a* is opened. Accordingly, the air 70*a* is introduced from the air supply source 70 into the balloon 64*a*, expanding the balloon 64*a*. The first support 62 is lifted until the base contact portion 62*a* of the first support 62 is brought into contact with the inner circumferential side surface 50$a_3$ of the base 50*a* (contacting step S40). After the base contact portion 62*a* has contacted the inner circumferential side surface 50$a_3$, the first solenoid-operated valve 68*a* is closed. FIG. 10 illustrates, in perspective, the jig 60 and other members that have undergone contacting step S40.

Figure 11:
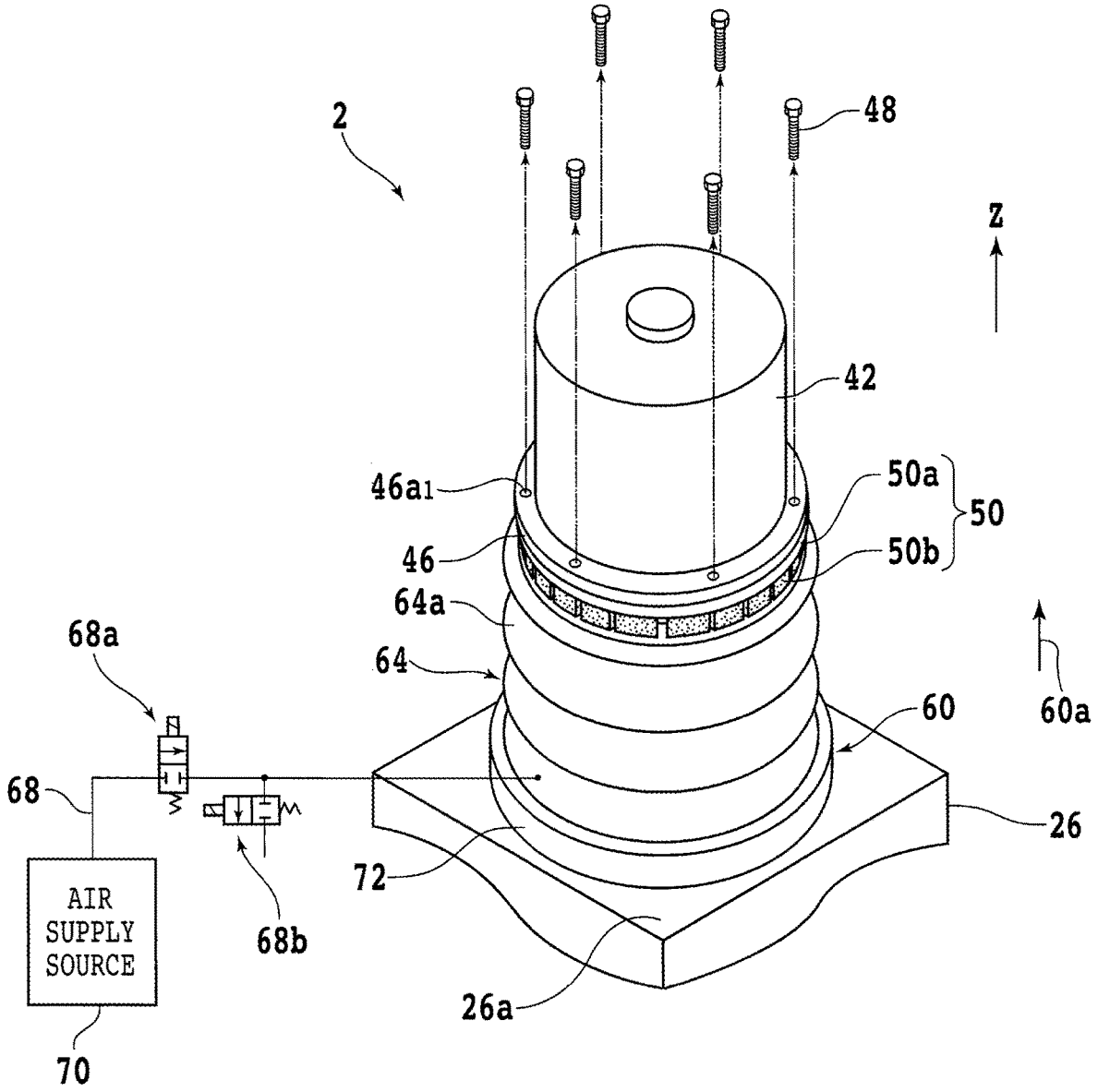
FIG. 11 is a perspective view illustrating a releasing step.

After contacting step S40, the bolts 48 are removed, releasing the mount 46 and the base 50*a* of the grinding wheel 50 from each other (releasing step S50). FIG. 11 illustrates releasing step S50 in perspective.

Figure 12:
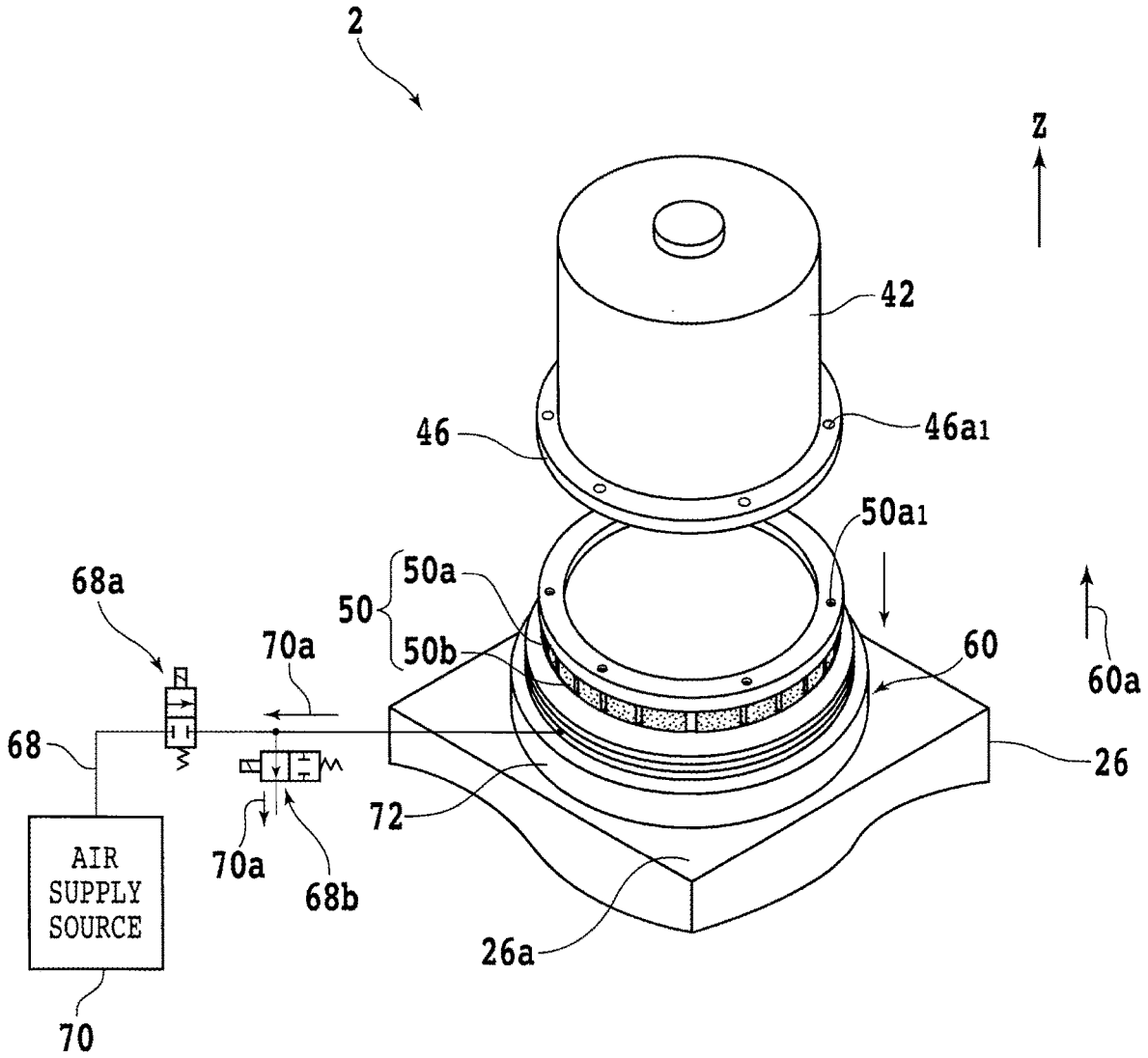
FIG. 12 is a perspective view illustrating a lowering step.

After releasing step S50, the first solenoid-operated valve 68*a* remains closed, and the second solenoid-operated valve 68*b* is opened, discharging the air 70*a* from the balloon 64*a* to allow the balloon 64*a* to deflate and collapse downwardly in the direction opposite to the heightwise direction 60*a*. The grinding wheel 50 is now lowered toward the second support 72 (lowering step S60). FIG. 12 illustrates lowering step S60 in perspective.

According to the present embodiment, inasmuch as the jig 60 that supports the grinding wheel 50 allows the operator to attach and remove the bolts 48 without supporting the grinding wheel 50 by hand, the labor required of the operator to mount and dismount the grinding wheel 50 can be reduced.

Figure 13:
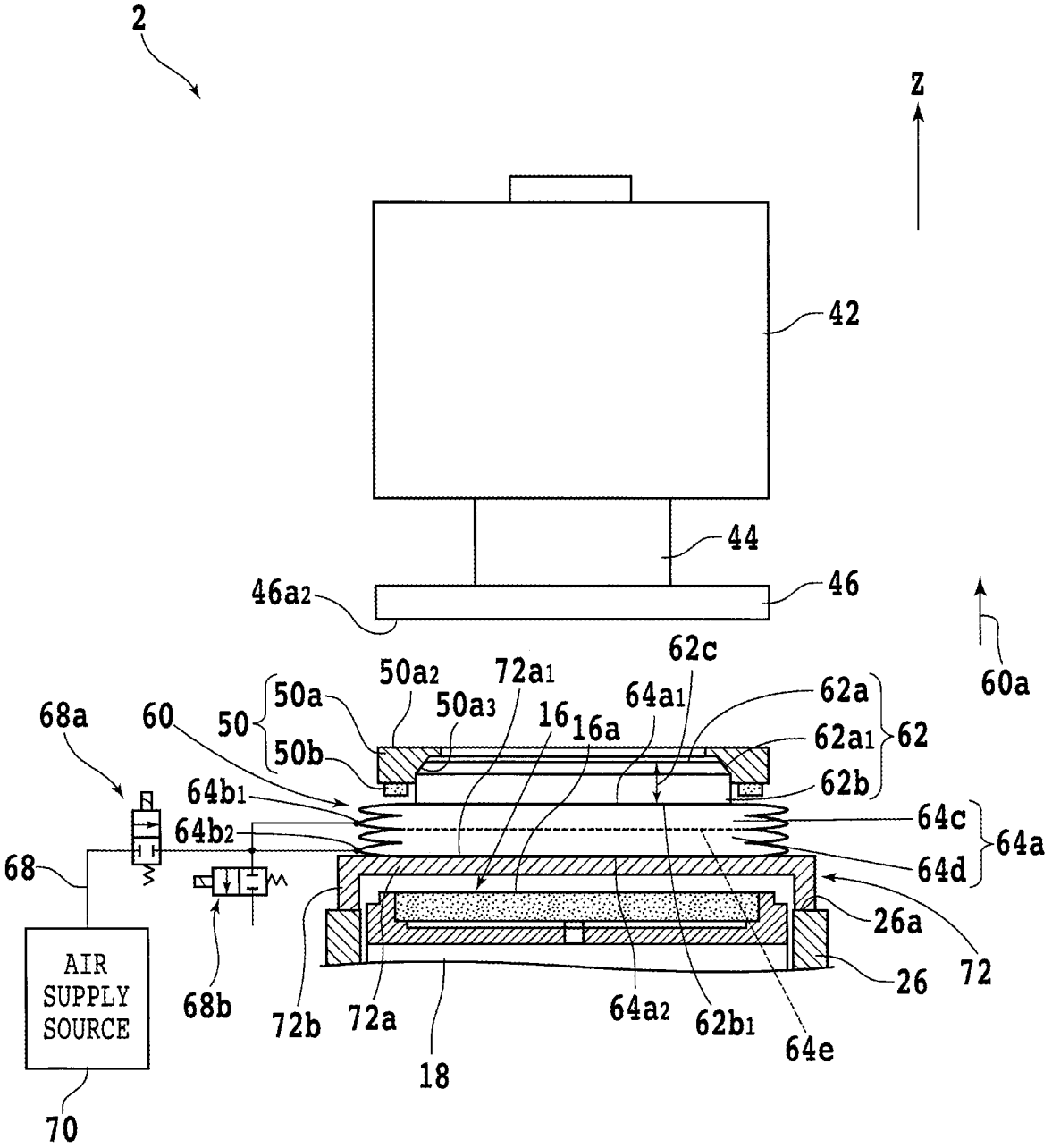
FIG. 13 is a side elevational view, partly in cross section, illustrating among others a balloon in a collapsed state according to a second embodiment of the present invention.

A jig 60 according to a second embodiment of the present invention will be described below with reference to FIG. 13. FIG. 13 illustrates a balloon 64*a* in a collapsed state according to the second embodiment and other members in side elevation, partly in cross section. The jig 60 according to the second embodiment is different from the jig 60 according to the first embodiment as to the structure of the balloon 64*a*. The balloon 64*a* according to the second embodiment has an upper balloon 64*c* and a lower balloon 64*d*, i.e., a plurality of balloons, that are joined in series together along the heightwise direction 60*a* and that have respective hollow cylindrical bellows-like side walls. A space defined in the upper balloon 64*c* and a space defined in the lower balloon 64*d* are isolated from each other by a boundary layer 64*e* and are independent from each other.

A first inlet/outlet port 64$b_1$ is provided on the lower end of the side wall of the upper balloon 64*c*, and a second inlet/outlet port 64$b_2$ is provided on the lower end of the side wall of the lower balloon 64*d*. In FIG. 13, each of the first inlet/outlet port 64$b_1$ and the second inlet/outlet port 64$b_2$ is indicated by a black dot. When air 70*a* is introduced through the first inlet/outlet port 64$b_1$ into the upper balloon 64*c* or discharged through the first inlet/outlet port 64$b_1$ from the upper balloon 64*c*, the upper balloon 64*c* is expanded or collapsed. When air 70*a* is introduced through the second inlet/outlet port 64$b_2$ into the lower balloon 64*d* or discharged through the second inlet/outlet port 64$b_2$ from the lower balloon 64*d*, the lower balloon 64*d* is expanded or collapsed.

According to the second embodiment, even if one of the upper balloon 64*c* and the lower balloon 64*d* is broken and the air 70*a* leaks out, the other of the upper balloon 64*c* and the lower balloon 64*d* can still be expanded and collapsed, so that the balloon 64*a* remains functional to a certain extent. Therefore, even if the upper balloon 64*c*, for example, is broken and the air 70*a* leaks out, the jig 60 reduces the risk of letting the grinding wheel 50 supported thereon be tilted and fall off the jig 60. According to the second embodiment, the balloon 64*a* includes two balloons. However, the balloon 64*a* may include three or more balloons.

Figure 14A:
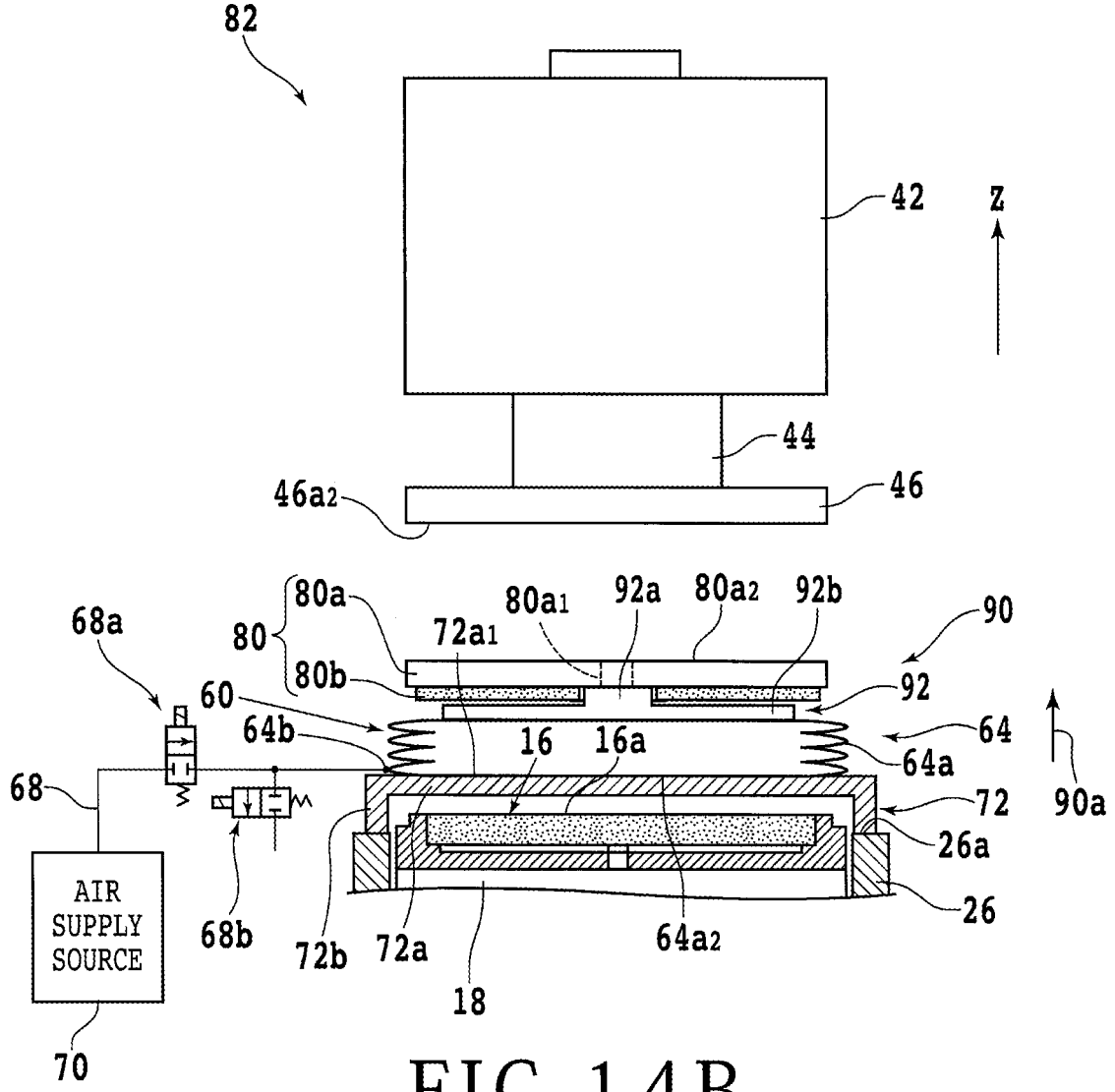
FIG. 14A is a side elevational view, partly in cross section, illustrating among others a balloon in a collapsed state according to a third embodiment of the present invention.
Figure 14B:
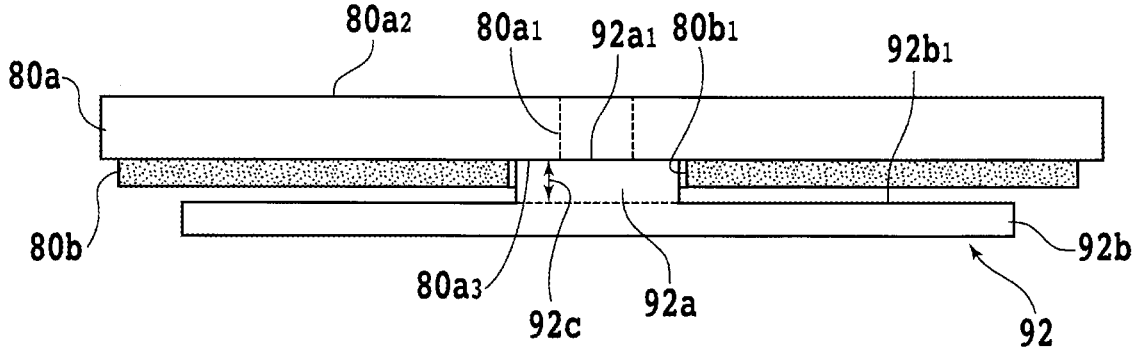
FIG. 14B is an enlarged side elevational view, partly in cross section, illustrating a polishing wheel and a first support.
Figure 15:
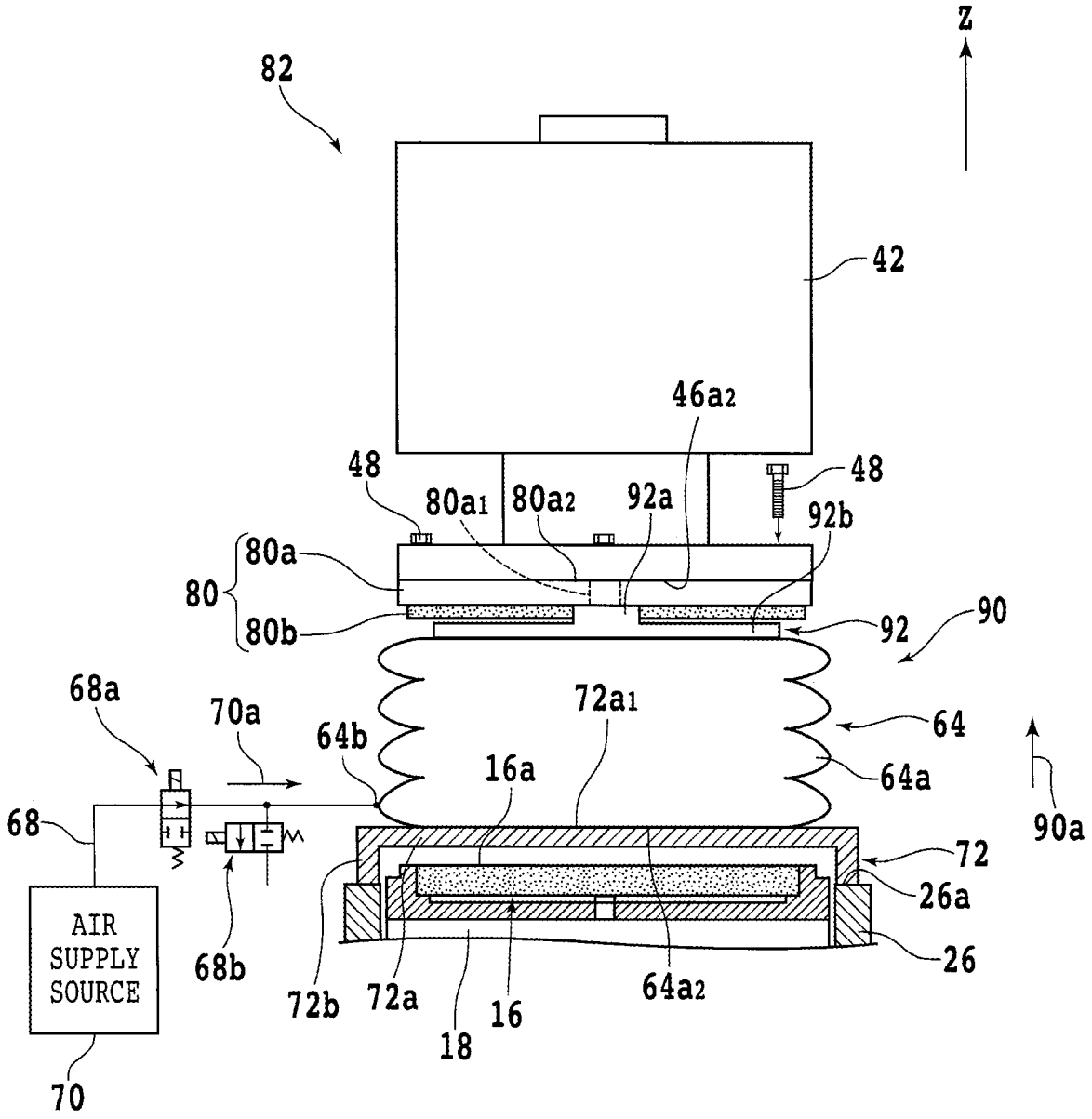
FIG. 15 is a side elevational view, partly in cross section, illustrating among others the balloon in an expanded state according to the third embodiment.

A jig 90 according to a third embodiment of the present invention will be described below with reference to FIGS. 14A, 14B, and 15. According to the third embodiment, the jig 90 is used to mount and dismount a grinding wheel, i.e., a processing tool, 80, instead of the grinding wheel 50, on and from the mount 46. The jig 90 is incorporated in a polishing apparatus 82 (see FIG. 14A) as a processing apparatus according to the third embodiment. FIG. 14A illustrates among others a balloon 64*a* in a collapsed state according to the third embodiment, in side elevation, partly in cross section. FIG. 14B illustrates a polishing wheel 80 and a first support 92 in enlarged side elevation, partly in cross section. The polishing wheel 80 has an annular base 80*a* made of a metal material such as aluminum alloy.

The base 80*a* has a through hole 80$a_1$ defined diametrically centrally therein. The through hole 80$a_1$ acts as a supply passage for a polishing liquid to be supplied to a workpiece 11 when it is polished on the polishing apparatus 82. The polishing wheel 80 also includes an annular pad 80*b* disposed on a lower surface of the base 80*a*. The pad 80*b* is made of nonwoven fabric impregnated with resin, a foamed resin, or the like. The pad 80*b* may contain abrasive grains, not illustrated, made of diamond or the like. If the pad 80*b* does not contain abrasive grains, then a polishing liquid mixed with free abrasive grains is supplied to the pad 80*b*. The pad 80*b* has a through hole 80$b_1$ defined therein concentrically with the through hole 80$a_1$. The through hole 80$b_1$ is larger in diameter than the through hole 80$a_1$.

The polishing wheel 80 has an outside diameter of 450 mm, for example. The polishing wheel 80 is supported on the jig 90 that is essentially identical in structure to the jig 60 according to the first or second embodiment. Those structural details of the jig 90 which are essentially identical to those of the jig 60 are omitted from description. The jig 90 has a first support 92 that is different in shape from the first support 62 according to the first or second embodiment. The first support 92 includes a cylindrical base contact portion 92*a* and a base 92*b* shaped as a circular plate that is larger in diameter than the base contact portion 92*a*.

As illustrated in FIG. 14B, the first support 92 supports the polishing wheel 80 thereon while keeping an upper surface 92$a_1$ of the base contact portion 92*a* in contact with an exposed surface 80$a_3$ of the base 80*a* that is positioned on a diametrically central portion of the base 80*a*. The first support 92 is capable of supporting the polishing wheel 80 without contacting the pad 80*b*, as described below.

The base contact portion 92*a* has a height 92*c* that is large enough to keep the lower surface of the pad 80*b* of the polishing wheel 80 supported on the first support 92 out of contact with the upper surface 92$b_1$ of the base 92*b*. Consequently, when a fresh polishing wheel 80 is supported on the first support 92 in order to be mounted on the mount 46, the pad 80*b* does not contact the components of the jig 90. The pad 80*b* is thus prevented from being smeared by dust, dirt, etc., deposited on the jig 90.

The base contact portion 92*a* may have protrusions, not illustrated, for supporting or securing a radially outer circumferential portion of the base 80*a* in at least three spots, instead of or in addition to the exposed surface 80$a_3$ that is positioned on the diametrically central portion of the base 80*a*.

According to the third embodiment, as with the first embodiment, when the balloon 64*a* is expanded and collapsed, it can lift and lower the polishing wheel 80. Therefore, the mounting method including placing step S10, lifting step S20, and fastening step S30 and the dismounting method including contacting step S40, releasing step S50, and lowering step S60 can be carried out by using the jig 90.

In the jig 90 illustrated in FIG. 14A, the second solenoid-operated valve 68*b* remains closed, and the first solenoid-operated valve 68*a* is opened. Accordingly, the air 70*a* is introduced from the air supply source 70 into the balloon 64*a*, expanding the balloon 64*a* along a heightwise direction 90*a*. FIG. 15 illustrates among others the balloon 64*a* in an expanded state according to the third embodiment. After the polishing wheel 80 has been lifted until an upper surface

80$a_2$ of the base 80*a* contacts the lower surface 46$a_2$ of the mount 46, the first solenoid-operated valve 68*a* is closed.

According to the third embodiment, the balloon 64*a* is expanded to move the polishing wheel 80 toward the mount 46. Therefore, even if the polishing wheel 80 collides with the mount 46, the impact on the mount 46 is reduced by the action of the balloon 64*a* to absorb the impact. When the first solenoid-operated valve 68*a* remains closed and the second solenoid-operated valve 68*b* is opened, the air 70*a* is discharged from the balloon 64*a* to allow the balloon 64*a* to deflate and collapse downwardly in the direction opposite to the heightwise direction 90*a*.

According to the third embodiment, since the jig 90 that supports the polishing wheel 80 allows the operator to attach and remove the bolts 48 without supporting the polishing wheel 80 by hand, the labor required of the operator to mount and dismount the polishing wheel 80 can be reduced. The structures, the methods, etc., according to the above embodiments may be changed and modified without departing from the scope of the present invention.

The grinding apparatus 2 and the polishing apparatus 82 may have a cleaning air nozzle, not illustrated. An air supply source connected to the cleaning air nozzle may be used as the air supply source 70 described above, so that the jigs 60 and 90 can be used in combination with the existing equipment. The gas to be introduced into the balloon 64*a* is not limited to the air 70*a*, and any of various other gases such as a nitrogen gas and a carbon dioxide gas may be used instead of the air 70*a*. According to the above embodiments, the air 70*a* is introduced and discharged through the single inlet/outlet port 64*b*. However, an inlet port and an outlet port may individually be provided on the balloon 64*a*.

Guide members, not illustrated, such as guide posts may be disposed along the balloon 64*a* to guide the balloon 64*a* to expand and collapse along the heightwise direction 60*a* or 90*a*.

Each of the grinding apparatus 2 and the polishing apparatus 82 is of the manual type where the operator manually places a workpiece 11 onto the holding surface 16*a*. However, each of the grinding apparatus 2 and the polishing apparatus 82 may be a fully automatic apparatus in which a workpiece 11 stored in a cassette is automatically introduced, ground or polished, cleaned, and then brought back into a cassette. The grinding apparatus 2 is not limited to an in-feed grinding apparatus and may be a creep-feed grinding apparatus. The polishing apparatus 82 is not limited to a wet-type polishing apparatus and may be a dry-type polishing apparatus.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A jig for mounting a processing tool on a mount of a processing apparatus,
- the processing apparatus including
  - a chuck table having a holding surface for holding a workpiece thereon,
  - a spindle being disposed above the holding surface of the chuck table and having a distal end portion to which the mount for supporting the processing tool mounted thereon is fixed, and
  - a seat structure disposed around the chuck table,
- the jig comprising:
- a first support for supporting the processing tool thereon;
- a second support positioned below the first support and supported on the seat structure; and
- a main body disposed between the first support and the second support, wherein
- the main body includes
  - a balloon that is expandable when gas is introduced thereinto and that is collapsible when the gas is discharged therefrom,
  - an inlet port for introducing the gas therethrough into the balloon, and
  - an outlet port for discharging the gas therethrough from the balloon, and
- the balloon with the processing tool supported on the first support is able to be expanded to move the processing tool toward the mount.

2. The jig according to claim 1, wherein the balloon has a plurality of balloons joined together in a direction from the second support toward the first support.

3. The jig according to claim 1, wherein
- the processing tool includes a base and a grindstone assembly or a pad fixed to the base, and
- the first support has a base contact portion capable of contacting the base without contacting the grindstone assembly or the pad.

4. The jig according to claim 1, wherein
- the second support includes
  - a leg adapted to be supported on the seat structure, and
  - a support table fixed to an upper end of the leg and adapted to be positioned above the chuck table, and
- the balloon has a lower surface held against an upper surface of the support table.

5. A method of mounting a processing tool, by using a jig, on a mount of a processing apparatus,
- the processing apparatus including
  - a chuck table having a holding surface for holding a workpiece thereon,
  - a spindle being disposed above the holding surface of the chuck table and having a distal end portion to which the mount for supporting the processing tool mounted thereon is fixed, and
  - a seat structure disposed around the chuck table,
- the jig including
  - a first support for supporting the processing tool thereon,
  - a second support positioned below the first support and supported on the seat structure, and
  - a main body disposed between the first support and the second support,
- the main body including
  - a balloon that is expandable when gas is introduced thereinto and that is collapsible when the gas is discharged therefrom,
  - an inlet port for introducing the gas therethrough into the balloon, and
  - an outlet port for discharging the gas therethrough from the balloon,
- the method comprising:
- a placing step of placing the processing tool on the first support;
- a lifting step of, after the placing step, lifting the processing tool toward the mount by introducing the gas into the balloon to expand the balloon; and
- a fastening step of, after the lifting step, fastening the mount and a base of the processing tool to each other while the base of the processing tool is held in contact with the mount.

6. A method of dismounting a processing tool, by using a jig, from a mount of a processing apparatus, the processing apparatus including a chuck table having a holding surface for holding a workpiece thereon, a spindle being disposed above the holding surface of the chuck table and having a distal end portion to which the mount for supporting the processing tool mounted thereon is fixed, and a seat structure disposed around the chuck table, the jig including a first support for supporting the processing tool thereon, a second support positioned below the first support and supported on the seat structure, and a main body disposed between the first support and the second support, the main body including a balloon that is expandable when gas is introduced thereinto and that is collapsible when the gas is discharged therefrom, an inlet port for introducing the gas therethrough into the balloon, and an outlet port for discharging the gas therethrough from the balloon, the method comprising:

a contacting step of bringing the first support into contact with the processing tool by introducing the gas into the balloon to expand the balloon;

a releasing step of, after the contacting step, releasing the mount and a base of the processing tool from each other; and a lowering step of, after the releasing step, lowering the processing tool toward the second support by discharging the gas from the balloon to collapse the balloon.

* * * * *